US005374981A

United States Patent [19]

Yamamoto et al.

[11] Patent Number: 5,374,981

[45] Date of Patent: Dec. 20, 1994

[54] ELECTROSTATIC RECORDING APPARATUS CAPABLE OF MAINTAINING CONSTANT GAP BETWEEN FLEXIBLE RECORDING ELECTRODES AND OPPOSITE ELECTRODE BY FLEXIBLE RECORDING ELECTRODES

[75] Inventors: Tadao Yamamoto, Tokyo; Kenichiro Asako, Kokubunju; Shigeru Shimizu; Eiichi Takeuchi, both of Iruma, all of Japan

[73] Assignee: Casio Computer Co., Ltd., Tokyo, Japan

[21] Appl. No.: 966,355

[22] Filed: Oct. 26, 1992

[30] Foreign Application Priority Data

Dec. 11, 1991 [JP] Japan ..... 3-327218
Dec. 11, 1991 [JP] Japan ..... 3-327219
Dec. 26, 1991 [JP] Japan ..... 3-344473

[51] Int. Cl.[5] ..... G03G 21/00

[52] U.S. Cl. ..... 355/259; 118/657; 355/245

[58] Field of Search ..... 355/245, 259, 261, 246, 355/260, 251; 118/659, 651, 653, 657, 647, 658; 430/35-37

[56] References Cited

U.S. PATENT DOCUMENTS 4,546,364 10/1985 Todoh .
4,739,348 4/1988 Ando et al. .
5,196,890 3/1993 Nakayama et al. ..... 355/259

FOREIGN PATENT DOCUMENTS

0487929A3 6/1992 European Pat. Off. .
59-121362 7/1984 Japan .
59-211068 11/1984 Japan .
60-42775 3/1985 Japan .
60-136775 7/1985 Japan .
61-194456 8/1986 Japan ..... 355/245
63-121863 5/1988 Japan .
63-174081 7/1988 Japan .
1-68770 3/1989 Japan .
1437604 6/1976 United Kingdom .

*Primary Examiner*—A. T. Grimley
*Assistant Examiner*—Shuk Y. Lee
*Attorney, Agent, or Firm*—Nixon & Vanderhye

[57] ABSTRACT

An electrostatic recording apparatus includes a developing agent carrier member provided to extend along a predetermined path. A developing agent convey unit conveys a developing agent along the surface of the developing agent carrier member. The developing agent carrier member has a step in a developing agent convey direction of its surface. A plurality of recording electrodes are aligned on an upper surface of the step of the developing agent carrier member and spaced apart from each other with gaps therebetween in a direction perpendicular to the developing agent convey direction, and project uniformly from the step. An opposite electrode is disposed to oppose the plurality of recording electrodes. A leaf spring member supports at least portions of the plurality of recording electrodes projecting from the step and can swing the projecting recording electrodes in directions to approach to and to separate from the opposite electrode. A voltage applying unit applies recording voltages to the plurality of recording electrodes in accordance with recording data to selectively transfer the developing agent conveyed along the surface of the developing agent carrier member to the opposite electrode.

7 Claims, 12 Drawing Sheets

ELECTROSTATIC RECORDING APPARATUS CAPABLE OF MAINTAINING CONSTANT GAP BETWEEN FLEXIBLE RECORDING ELECTRODES AND OPPOSITE ELECTRODE BY FLEXIBLE RECORDING ELECTRODES

BACKGROUND OF THE INVENTION

1. Field of the Invention

The present invention relates to an electrostatic recording apparatus for forming a recording image by transferring a developing agent conveyed along a predetermined path to a recording medium in accordance with recording data.

2. Description of the Related Art

A multi-stylus printer is conventionally known well as one of electrostatic recording apparatuses. In the multi-stylus printer, a multiple of styluses are aligned at a small pitch in the main scanning direction to constitute a recording head, voltages are selectively applied to the styluses in accordance with recording signals, and discharge is directly performed to a copy sheet to form an electrostatic latent image. In this case, special paper coated with an agent having a high electric resistance is used to easily and stably hold electrons on the copy sheet. However, letters and figures cannot be written well on such special paper with a pen or pencil. Also, since the special paper is denatured depending on the environmental conditions, e.g., the humidity, it cannot be kept for a long period of time. Hence, the special paper is not preferred for office use.

When a gap between the distal ends of the styluses and the surface of the copy sheet is large, the discharge electric field is spread to increase the size of dots to be formed, making it difficult to obtain a recording image having a high resolution. For this reason, a gap material is provided on the surface of the copy sheet and brought into slidable contact with the distal ends of the styluses, thus ensuring a small gap. In this case, however, the distal ends of the styluses are worn.

Thus, as an electrostatic recording scheme with which plain paper can be used and a small gap can be correctly maintained between the image medium and the distal ends of styluses, a scheme with which a toner image is formed on a drum-shaped intermediate recording medium and the toner image is transferred to the copy sheet is used. When this scheme is employed, the size of the entire apparatus can be increased as it uses the intermediate recording medium. Thus, a process of performing recording and development simultaneously is usually employed to avoid an increase in size of the apparatus. Mostly in this case, recording electrodes are aligned in the widthwise direction (main scanning direction) of the developing agent transfer path and the developing agent is transferred from the recording electrodes to the surface of an opposite electrode serving as the intermediate recording medium, thereby forming a toner image. With this scheme, since the electrode-to-electrode gap between the recording electrodes and the opposite electrode affects the density of the image or background smearing, the gap must have a constant appropriate width throughout the entire portion of the widthwise direction. That is, if the electrode-to-electrode gap is excessively narrow, although a high density can be obtained, background smearing occurs. Inversely, if the electrode-to-electrode gap is excessively wide, although no background smearing occurs, a high density cannot be obtained.

The opposite electrode usually forms a drum so that it can also serve as the recording medium. When the opposite electrode drum is rotated, the circumferential surface of the opposite electrode swings in the axial or circumferential direction to change the electrode-to-electrode gap. Also, a small projection can be undesirably formed during the manufacture on the developing agent convey path along which the recording electrodes are located. In this case, the recording electrodes are moved close to the opposite electrode by a distance corresponding to this projection.

SUMMARY OF THE INVENTION

It is, therefore, an object of the present invention to provide an electrostatic recording apparatus in which a gap between recording electrodes and an opposite electrode is maintained to stably form a high-density, high-quality recording image having no background smearing over a long period of time.

In order to achieve the object described above, according to the first aspect of the present invention, there is provided an electrostatic recording apparatus comprising:

- a developing agent carrier member having a surface and provided to extend along a predetermined path;
- developing agent convey means for conveying a developing agent along the surface of the developing agent carrier member, the developing agent carrier member having a step in a developing agent convey direction of the surface thereof;
- a plurality of recording electrodes aligned on an upper surface of the step of the developing agent carrier member and spaced apart from each other with gaps therebetween in a direction perpendicular to the developing agent convey direction, and projecting uniformly from the step;
- an opposite electrode disposed to oppose the plurality of recording electrodes;
- a leaf spring member for supporting at least portions of the plurality of recording electrodes projecting from the step, the leaf spring member being capable of swinging the projecting recording electrodes in directions to approach to and to separate from the opposite electrode; and
- voltage applying means for applying recording voltages to the plurality of recording electrodes in accordance with recording data to selectively transfer the developing agent conveyed along the surface of the developing agent carrier member to the opposite electrode.

According to the second aspect of the present invention, there is provided an electrostatic recording apparatus comprising:

- a developing agent carrier member having a surface and provided to extend along a predetermined path;
- developing agent convey means for conveying a developing agent along the surface of the developing agent carrier member;
- a plurality of recording electrodes aligned on the surface of the developing agent carrier member and spaced apart from each other with predetermined gaps therebetween,
- the developing agent carrier member being substantially parallel with a developing agent convey direction and having a flat portion formed throughout an entire surface of the developing agent carrier member in a main scanning direction, and the plurality of recording electrodes being stacked with an elastic support member for supporting the plurality of recording electrodes on the flat portion so as to uniformly project from the flat portion;

opposite electrode disposed to oppose the plurality of recording electrodes; and voltage applying means for applying recording voltages to the plurality of recording electrodes in accordance with recording data to selectively transfer the developing agent conveyed along the surface of the developing agent carrier member to the opposite electrode.

According to the third aspect of the present invention, there is provided an electrostatic recording apparatus comprising:

a developing agent carrier member having a surface and provided to extend along a predetermined path;

developing agent convey means for conveying a developing agent along the surface of the developing agent carrier member;

a plurality of recording electrodes aligned on the surface of the developing agent carrier member and spaced apart from each other with predetermined gaps therebetween in a direction perpendicular to a developing agent convey direction;

a member provided at locations of the predetermined gaps where the developing agent is conveyed and having substantially the same charge system as that of a charge system of the developing agent;

an opposite electrode disposed to oppose the plurality of recording electrodes; and voltage applying means for applying recording voltages to the plurality of recording electrodes in accordance with recording data to selectively transfer the developing agent conveyed along the surface of the developing agent carrier member to the opposite electrode.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The preferred embodiments of the present invention will be described with reference to the accompanying drawings.

Figure 1:
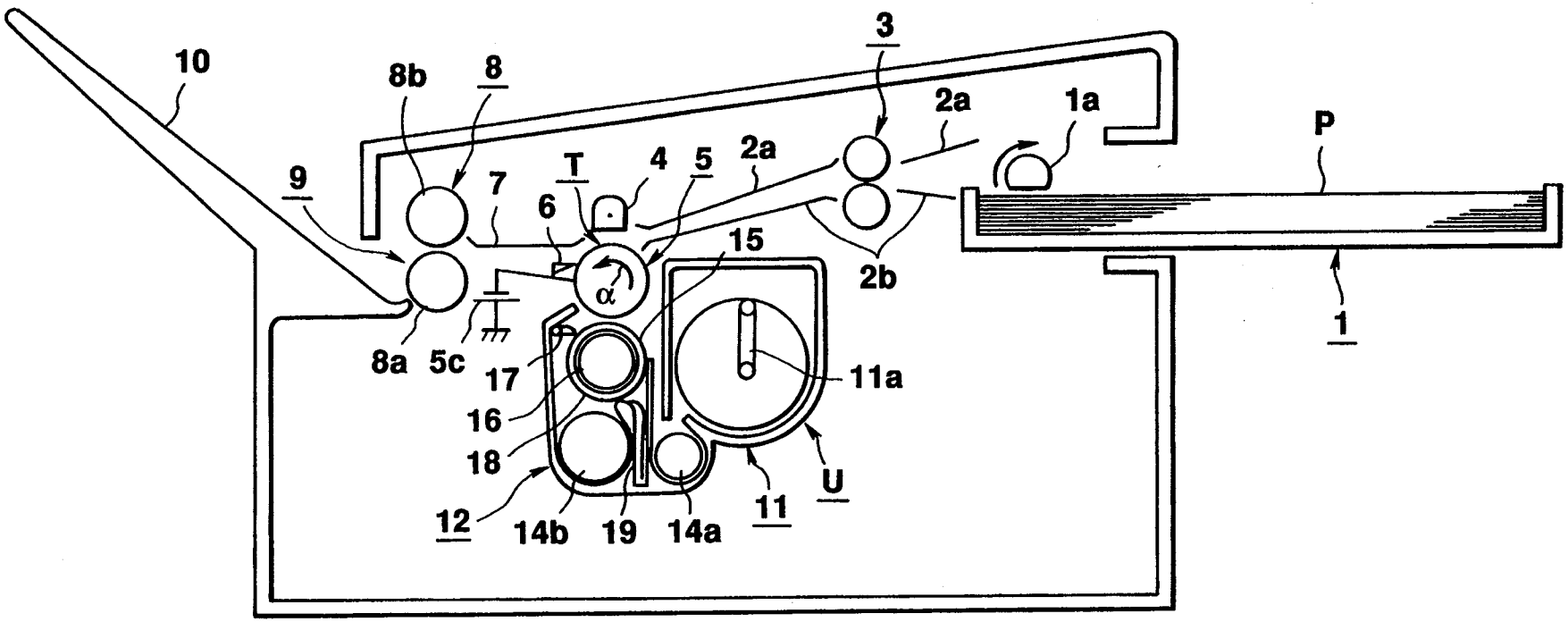
FIG. 1 is a schematic sectional view showing the entire arrangement of an electrostatic recording apparatus according to the first embodiment of the present invention.

FIG. 1 is a schematic sectional view showing the entire arrangement of a recording apparatus according to the first embodiment of the present invention. Referring to FIG. 1, a paper feed cassette 1 stacking and storing plain paper P therein is detachably mounted in a side portion of the machine frame. A paper feed roll 1*a* is disposed above the distal end portion of the inserted paper feed cassette 1 to be rotatable in the direction of the arrow. Upper and lower convey guide plates 2*a* and 2*b* made of an insulating material are provided in front of the paper feed roll 1*a* to form a paper load path. A pair of resist rolls 3 are disposed midway along the paper load path. The pair of resist rolls 3 temporarily stop travel of the paper P picked up by the paper feed roll 1*a* to adjust the convey posture of the paper, and thereafter feed it again to an image transfer unit T on the downstream to be synchronism with a timing at which a recording image to be described later is supplied to the transfer unit T.

Figure 4:
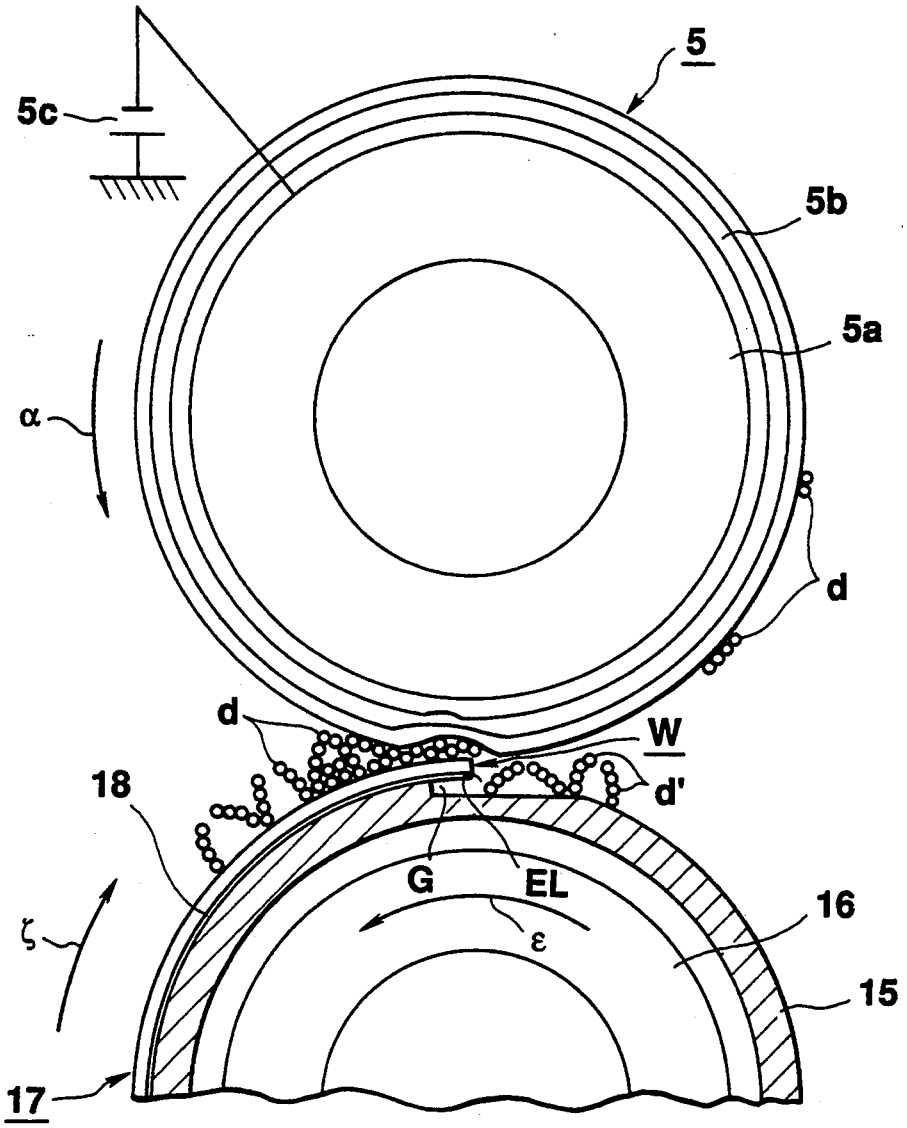
FIG. 4 is a schematic side sectional view showing the arrangement of a recording unit and an electrode cylinder of the first embodiment.

A transfer charger 4 is disposed in the image transfer unit T on the downstream of the pair of resist rolls 3 to oppose the upper circumferential surface of an electrode cylinder 5 serving also as an image carrier. The electrode cylinder 5 serves as an electrode opposite to recording electrodes to be described later, and is obtained by applying a surface layer 5*b* made of an elastic material on the circumferential surface of a pipe 5*a* made of a conductive material, e.g., a metal, as shown in FIG. 4. As an elastic material forming the surface layer 5*b*, a material having a surface hardness Hs=20° to 90° under a method of JIS spring type measurement and a volume electric resistivity (specific resistance) of $1\times10^{6}$ to $1\times10^{11}$ [Ω·cm] to provide an effect as the opposite electrode is selected. The electrode cylinder 5 of this embodiment is obtained by applying the surface layer 5*b* made of conductive urethane rubber having a surface hardness Hs=90° and a volume electric resistivity of $1\times10^{11}$ [Ω·cm] on the circumferential surface of the pipe 5*a* made of stainless steel.

Referring back to FIG. 1, in this embodiments, the electrode cylinder 5 fabricated in the above manner is rotated counterclockwise in the direction indicated by an arrow α. A recording image forming unit U to be described later is disposed to oppose the circumferential surface of the electrode cylinder 5 opposite to the image transfer unit T. A toner recording image is formed on the surface of the electrode cylinder 5 by the recording image forming unit U, conveyed to the image transfer unit T as the electrode cylinder 5 is rotated, and transferred to a copy sheet which is fed to the image transfer unit T. The arrangement of the recording image forming unit U will be described later in detail.

A separation gripper 6 is disposed on the downstream of the image transfer unit T to urge its distal end against the circumferential surface of the electrode cylinder 5. An air suction type conveyor belt 7 extends horizontally on the downstream of the separation gripper 6. A sheet to which a recording image has been transferred and which is separated from the circumferential surface of the electrode cylinder 5 by the separation gripper 6 is conveyed toward a fixing unit 8 ahead of the conveyor belt 7 while the lower surface of the sheet is kept chucked by the conveyor belt 7. The fixing unit 8 consists of a heat roll 8*a* and a press roll 8*b* and thermally fixes a toner image on a sheet while they clamp and convey the sheet therebetween. The sheet after toner image fixing is discharged to and stacked on a discharge paper tray 10 in the faced down state with its image surface facing downward.

As described above, in the recording apparatus of this embodiment, since the entire sheet convey path from paper feed to paper discharge is linearly formed, the paper passage operation is generally smooth, and paper passage defects such as a defective image and jamming do not easily occur. Also, the faced down paper discharge state free from page alignment on behalf of the recording apparatus can be obtained by the linear paper passage path described above.

The arrangement of the recording image forming unit U will be described in detail.

The recording image forming unit U roughly constituted by a developing agent reservoir tank 11 for reserving a developing agent for replenishment and a developing/recording tank 12 having a recording means and a developing means. An agitating blade 11*a* is pivotally disposed in the developing agent reservoir tank 11. In this embodiment, an insulating magnetic toner as a one-component developing agent which contains at least an insulating resin, fine magnetic powder, and coloring particles and which has a negative friction charge polarity (−) is used. A two-component developing agent obtained by mixing a magnetic carrier and an insulating toner at a predetermined ratio can also be used as the developing agent.

Figure 3:
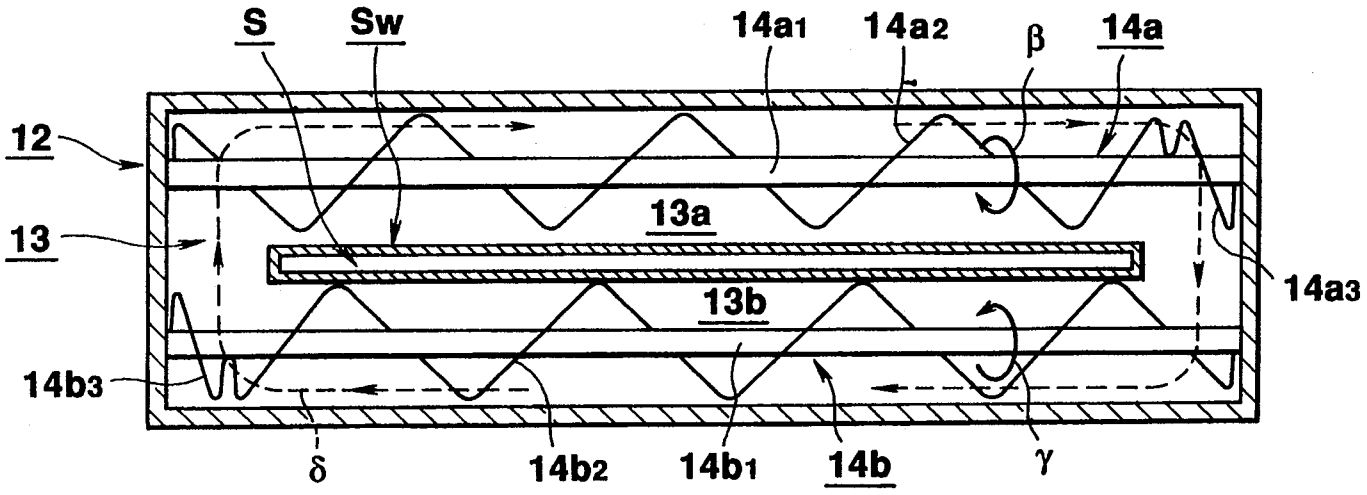
FIG. 3 is a cross-sectional view showing a horizontal circulation path for a developing agent in the recording image forming unit.

A horizontal circulation path 13 for the developing agent shown in FIG. 3 is formed on the bottom portion of the developing/recording tank 12. Referring to FIG. 3, a pair of auger rolls 14*a* and 14*b* are rotatably disposed in a pair of parallel elongated paths 13*a* and 13*b*, respectively, in the horizontal circulation path 13. A plurality of helical blades 14*a*2 and 14*b*2 are formed upright on the circumferential surfaces of shafts 14*a*1 and 14*b*1, and counter feed blades 14*a*3 and 14*b*3 having opposite helical directions are formed upright on the opposite end portions of the shafts 14*a*1 and 14*b*1, thereby forming the auger rolls 14*a* and 14*b* (see the perspective view of FIG. 5). The auger rolls 14*a* and 14*b* are disposed in the elongated paths 13*a* and 13*b*, respectively, so that their counter feed blades 14*a*3 and 14*b*3 are located on the opposite sides. The pair of auger rolls 14*a* and 14*b* are rotated in the opposite directions as indicated by arrows D and T to convey the developing agent toward the counter feed blades 14*a*3 and 14*b*3, respectively. As a result, the convey forces in the opposite facing directions collide in the corner portions where the counter feed blades 14*a*3 and 14*b*3 are provided to squeeze the magnetic toner in the vertical direction to be flowed into the each other elongated paths. In this embodiment, the magnetic toner can be circulated in this manner in the direction indicated by a broken arrow δ as it is agitated, and can be sufficiently triboelectrified during circulation. The developing agent can be sufficiently triboelectrified to a degree necessary as the developing agent by appropriately selecting the material and shape of the auger rolls 14*a* and 14*b*.

Figure 2:
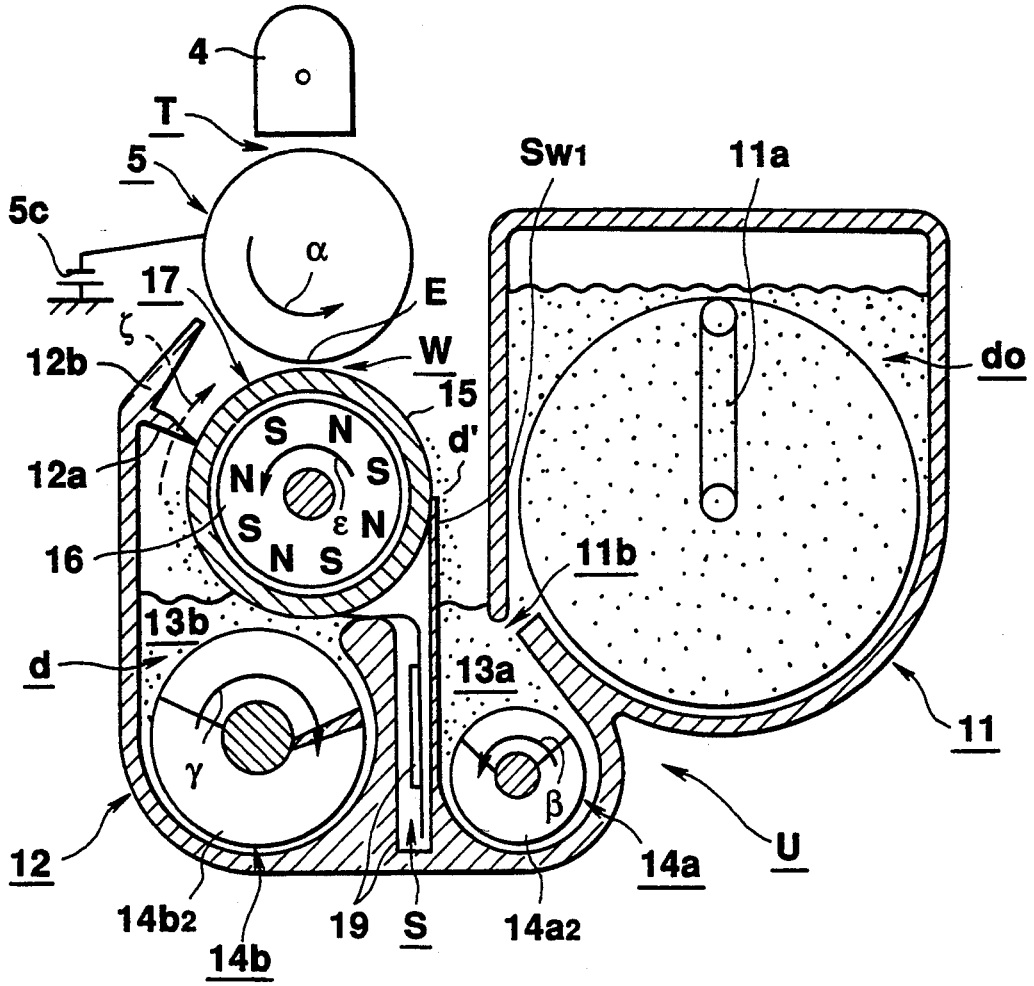
FIG. 2 is a schematic sectional view showing a recording image forming unit shown in FIG. 1 with its peripheral arrangement.

A space S surrounded by a wall Sw so that the circulating developing agent will not enter is formed in the central portion of the horizontal circulation path 13 formed in the manner described above. As shown in FIG. 2, a replenishment port 11*b* for a replenishing magnetic toner d0 is formed in the developing agent reservoir tank 11 in the axial direction of the auger roll 14*a* above the auger roll 14*a* close to the tank 11.

A developing sleeve 15 as a developing agent carrier member is provided above the other auger roll 14*b* to extend in the horizontal direction. The developing sleeve 15 rotatably incorporates a magnet roll 16 serving as a developing agent convey means, and opposes the electrode cylinder 5 described above. Opposite magnetic poles are alternately formed on the circumferential surface of the magnet roll 16. When the magnet roll 16 is rotated counterclockwise in the direction indicated by an arrow ϵ, a magnetic toner d is conveyed clockwise in the direction indicated by a broken arrow ζ vertically along the circumferential surface of the developing sleeve 15.

A doctor blade 12*a* for regulating the thickness of the magnetic toner d to an appropriate value is disposed on the upstream of the developing agent convey direction ζ in the vicinity of the circumferential surface of the developing sleeve 15 that serves as the developing agent vertical convey path. A toner scatter preventive plate 12*b* is disposed above the doctor blade 12*a*. The toner scatter preventive plate 12*b* prevents the developing agent which is thickness-regulated by the doctor blade 12*a* and conveyed to the downstream from scattering to outside the recording image forming unit U to soil the image. In this embodiment, the upper end portion of the developing/recording tank 12 is branched into two pieces to form the doctor blade 12*a* and the toner scatter preventive plate 12*b*, respectively.

A recording portion W for forming a toner recording image on the circumferential surface of the electrode cylinder 5 is provided on the downstream of the toner thickness regulating portion along the toner convey direction ζ in the following manner.

As shown in FIG. 4, in this embodiment, a step G is formed in the circumferential surface of the developing sleeve 15 closely opposing the circumferential surface of the electrode cylinder 5. The step G is formed to extend along the entire width of the circumferential surface of the developing sleeve 15.

Figure 5:
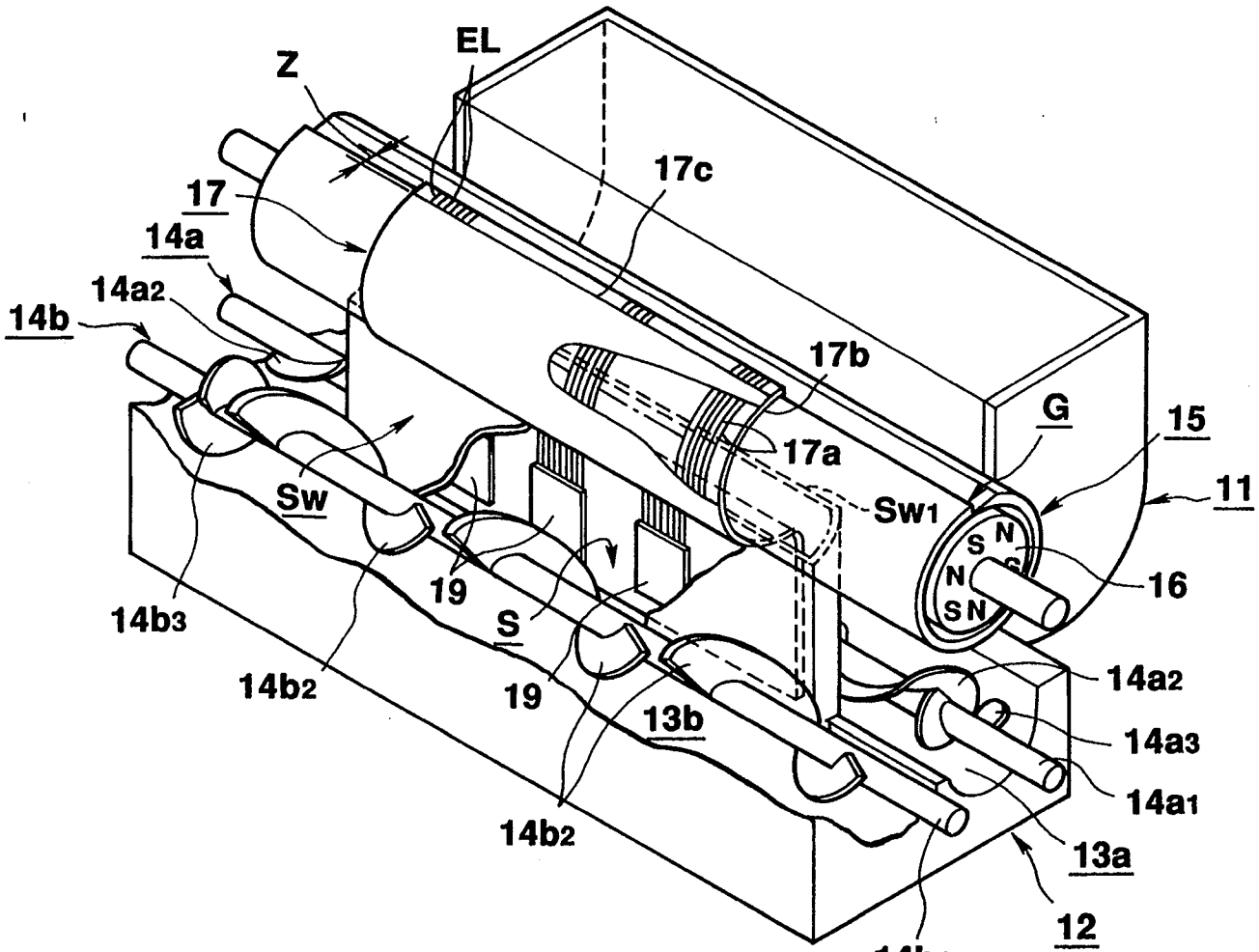
FIG. 5 is a perspective view showing the entire arrangement of the recording image forming unit.

A recording electrode sheet 17 having a multiple of recording electrodes is applied on the step G and a portion of the circumferential surface of the developing sleeve 15 on the upstream of the step G through a leaf spring member 18. As shown in FIG. 5, the recording electrode sheet 17 is constituted by forming a multiple of recording electrode wires 17*a* to extend parallel with each other in the longitudinal sheet direction along the circumferential direction of the circumferential surface of the developing sleeve 15 and to be aligned at a predetermined small pitch in the widthwise direction of the sheet (widthwise direction of the toner convey path: main scanning direction). The number of recording electrode wires 17*a* coincides with the maximum number of data per main scanning line. The recording electrode sheet 17 of this embodiment is made of a flexible printed circuit board (FPC), and the multiple of recording electrode wires 17*a* made of a non-magnetic conductive material are patterned on a base film 17*b* made of a flexible insulating material at a pitch of 86.4 μm (300 DPI) to be spaced apart from each other by 40 μm.

An insulating coating film 17*c* is applied on the surface of the recording electrode sheet 17 excluding a distal end region Z that is concerned with recording image formation. Hence, insulation between the adjacent recording electrode wires 17*a* can be ensured, and wear of the recording electrode wires 17*a* caused by friction with the magnetic toner can be prevented. The distal end portions of the recording electrode wires 17*a* not applied with the insulating coating film 17*c* of the recording electrode sheet 17 serve as recording electrodes EL for forming the recording image.

Figure 6:
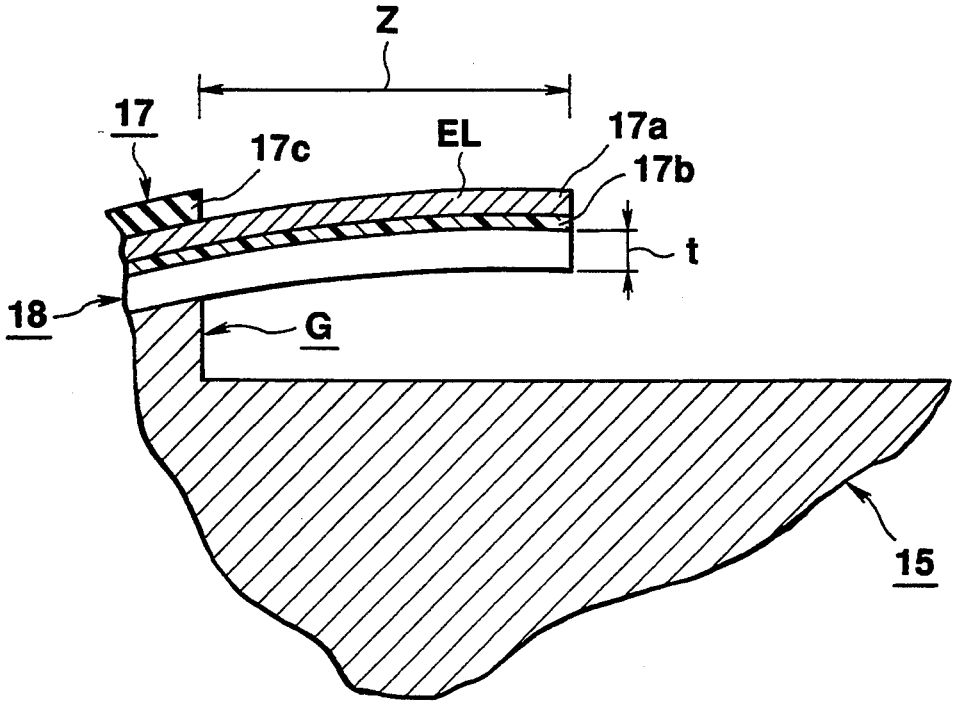
FIG. 6 is a schematic sectional view showing recording electrodes of the recording unit of the first embodiment.

Referring to FIG. 6, the recording electrode sheet 17 fabricated in the above manner is laid on the leaf spring member 18, and the resultant two-layer sheet member is applied on the circumferential surface of the developing sleeve 15. In this case, the distal end portion Z of the double sheet member on which the recording electrodes EL are aligned is set to project uniformly from the upper surface of the step G to the downstream throughout its entire width. Then, the distal end portion Z on which the recording electrodes EL are aligned can be set to flexibly swing in the direction of the thickness (vertical direction in FIG. 6). In order to obtain the recording electrodes EL that do not droop by their own weight, thus providing a buffer effect (cushion function) to be described later, projection sizes (length of the recording electrodes) of the recording electrode sheet 17 and the leaf spring member 18 may be set to about 1 to 10.0 mm, and a thickness t of the leaf spring member 18 may be set to 5 to 200 μm. Preferably, the thicknesses and the projection sizes Z of the base film 17*b* and the leaf spring member 18 may be set such that the load obtained when the recording electrodes EL are pushed by a pin having a size of 0.5 $mm^2$ (area of the distal end) by 0.5 mm becomes 30 to 40 g. In this embodiment, both the length of each recording electrode EL and the projection size of the two-layer sheet member are set to Z. However, the length of each recording electrode EL may be set larger than the projection size of the two-layer sheet member. Also, the leaf spring member 18 may be laid not on the entire length of the recording electrode sheet 17 but only on the projecting portions of the recording electrodes EL.

When the recording electrode sheet 17 described above is to be fabricated, referring to FIG. 6, the base film 17*b* made of a flexible insulating member and applied with copper foils is etched to pattern the multiple of recording electrode wires 17*a*, the insulating coating film 17*c* is formed on the region of the base film 17*b* excluding the distal end region z to form the recording electrodes EL, thereby forming the recording electrode sheet 17. This recording electrode sheet 17 is applied on the leaf spring member 18 to obtain the two-layer sheet member.

Figure 7:
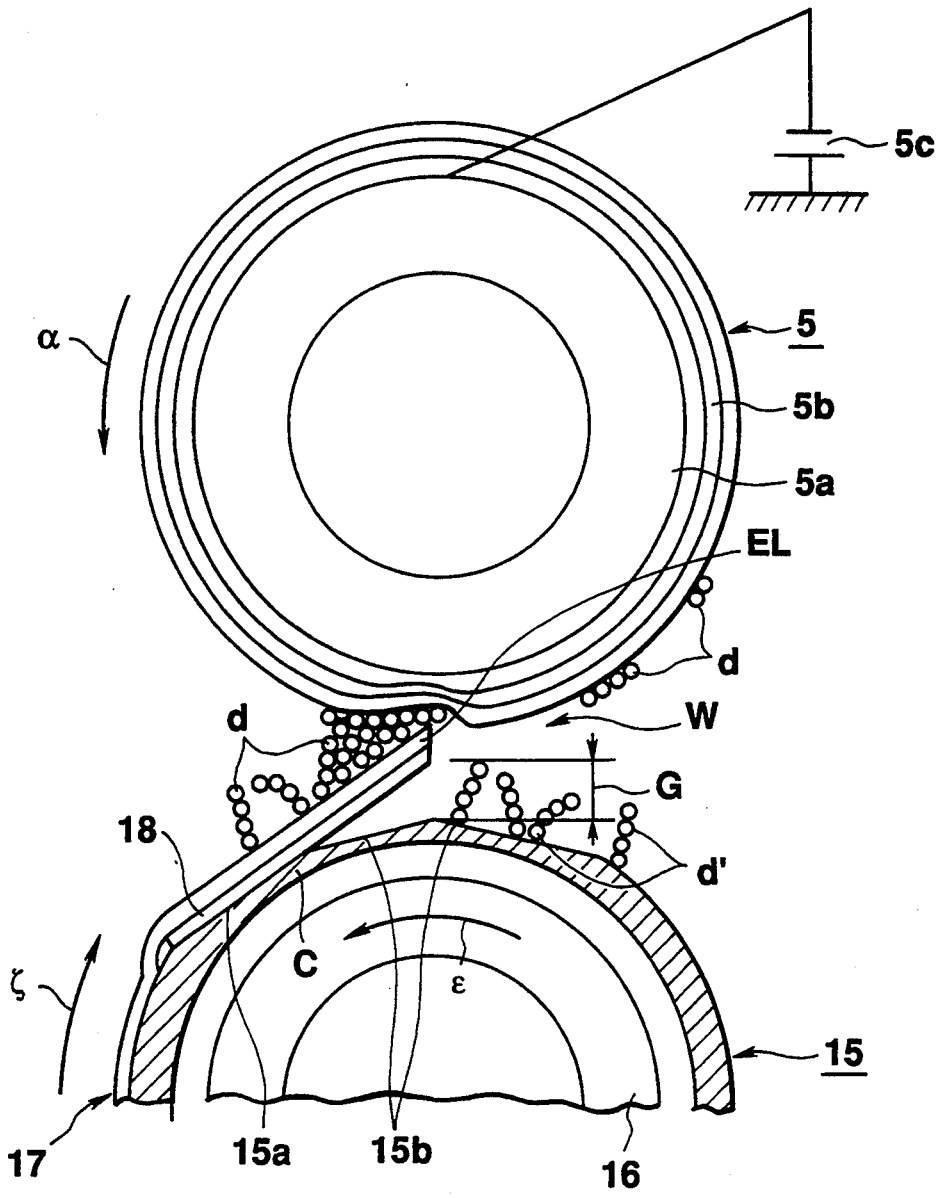
FIG. 7 is a schematic side sectional view showing the arrangement of a recording unit and an electrode cylinder of the second embodiment of the present invention.

The recording electrodes EL and the electrode cylinder 5 are arranged such that the circumferential surface of the surface layer 5*b* of the electrode cylinder 5 described above made of an elastic material is brought into tight contact with the upper surfaces of the recording electrodes EL fabricated in the above manner, as shown in FIG. 7. In this case, the recording electrodes EL and the electrode cylinder 5 may be in tight contact with each other such that the surface layer 5*b* of the electrode cylinder 5 is slightly flexed. As a result, the upper surfaces of the recording electrodes EL and the electrode cylinder 5 can be reliably brought into contact with each other throughout the entire width of the recording portion W.

The second embodiment of the present invention will be described.

In the second embodiment, the surface of a developing sleeve 15 closely opposing the circumferential surface of an electrode cylinder 5 is flattened to form flat portions 15*a* and 15*b*, as shown in FIG. 7. The flat portions 15*a* and 15*b* are formed to extend along the entire width of the circumferential surface of the developing sleeve 15, as shown in FIG. 7. One side of a leaf spring member 18 serving as a support member for recording electrodes is fixed on the flat portion 15*a* on the upstream side. Accordingly, the other portion of the leaf spring member 18 (the portion on the downstream side) extends above the flat portion 15*b* on the downstream side, i.e., is cantilevered, thus defining a step G with respect to the surface of the developing sleeve 15. One end portion of a recording electrode sheet 17 on which a multiple of recording electrodes are formed is laid and fixed on the leaf spring member 18. The structure of the recording electrode sheet 17 is the same as that of the first embodiment, and a detailed description thereof will be omitted.

Figure 8:
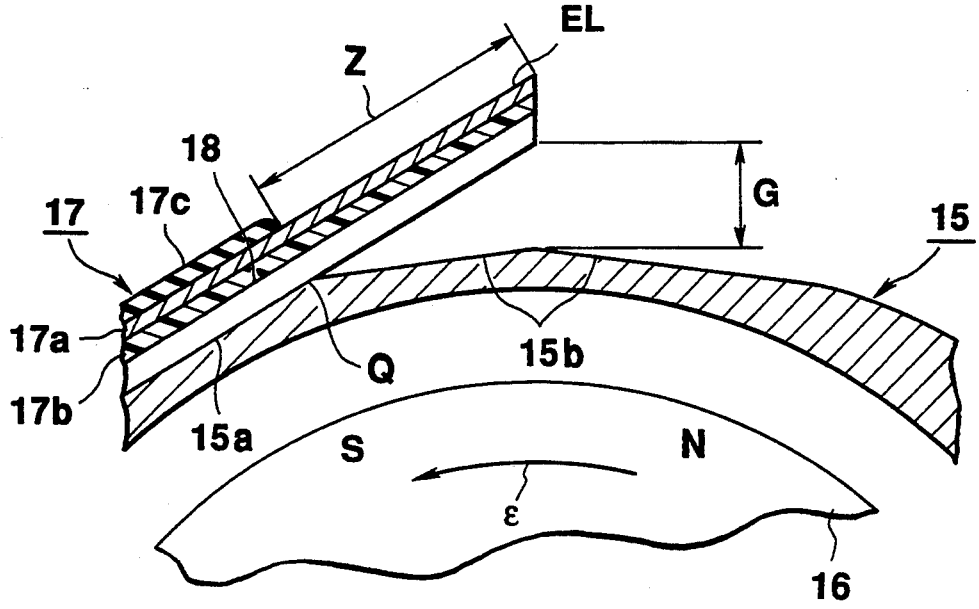
FIG. 8 is a schematic enlarged sectional view showing recording electrodes of the recording unit of the second embodiment in detail.

Referring to FIG. 8, the recording electrode sheet 17 having the structure as described above is laid on the leaf spring member 18 such that their distal end faces are flush. A front end portion Z of the multi-layered recording electrode sheet 17 on which the recording electrodes EL are formed uniformly projects from a separating point Q to the downstream side in the toner convey direction throughout the entire width of the developing sleeve 15, and the distal end of the front end portion Z is located immediately under a portion of the circumferential surface of the electrode cylinder 5 closest to the developing sleeve 15. When the recording electrodes EL are formed in this manner, the distal end portion Z on which the recording electrodes EL are aligned can be set to flexibly swing in the direction of the thickness (vertical direction in FIG. 8). In order to obtain the recording electrodes EL that do not droop by their own weight, thus providing a buffer effect (cushion function) to be described later, projecting sizes (length of the recording electrodes) of the recording electrode sheet 17 and the leaf spring member 18 may be set to about 0.5 to 10.0 mm, and a thickness t of the leaf spring member 18 may be set to 5 to 200 μm. Preferably, the thicknesses and the projection sizes Z of a base film 17*b* and the leaf spring member 18 may be set such that the load obtained when positions of the surfaces of the recording electrodes EL behind their front ends by 1 mm are pushed by a pin having a size of 0.5 $mm^2$ (area of the distal end) by 0.5 mm becomes 10 to 100 g and preferably 30 to 40 g. In this embodiment, both the length of each recording electrode EL and the projection size of the multi-layer sheet member are set to Z. However, the applied area of an insulating coating film 17c may be decreased and the length of each recording electrode EL may be set larger than the projecting size of the multi-layer sheet member.

When the recording electrode sheet 17 described above is to be fabricated, referring to FIG. 8, the base film 17b made of a flexible insulating member and applied with copper foils is etched to pattern a multiple of recording electrode wires 17a, the insulating coating film 17c is formed on the region of the base film 17b excluding the front end portion Z to form the recording electrodes EL, thereby forming the recording electrode sheet 17. This recording electrode sheet 17 may be applied on the leaf spring member 18, thus obtaining the recording electrode sheet 17. In this case, since the leaf spring member 18 forms a flat surface, the front end portion Z of the recording electrode sheet 17 on which the recording electrodes EL are formed can be easily reliably applied on the leaf spring member 18. Also, since the surface of the developing sleeve 15 on which the multi-layered sheet member is to be applied also forms a flat surface (flat portion 15a), the multi-layered sheet member can be reliably and easily fixed on the developing sleeve 15.

In the first and second embodiments, since the recording portion W is constituted in the above manner, the gap between the upper surfaces of the recording electrodes EL and the circumferential surface of the electrode cylinder 5 can be held at a predetermined value, and the amount of magnetic toner entering this gap can always be regulated to an appropriate value. Therefore, a high-density image having no background smearing can be obtained, and the magnetic toner is reliably prevented from attaching to the upper surfaces of the recording electrodes EL. The reason for these facts will be described with reference to FIGS. 4, 6, 9, 10A, and 10B. Note that FIGS. 9, 10A, and 10B are schematic elevations, respectively, of the recording portion W seen from the downstream side of the toner convey direction.

Figure 9:
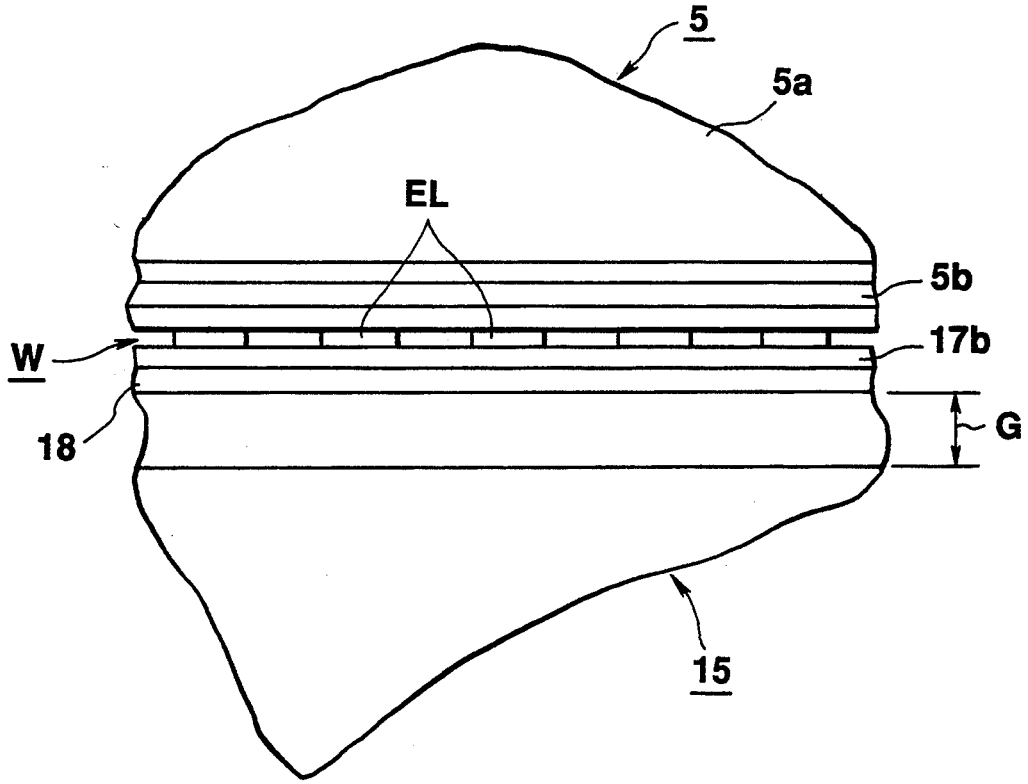
FIG. 9 is a schematic sectional view of the recording unit for explaining the advantages of the first and second embodiments of the present invention.
Figure 10A:
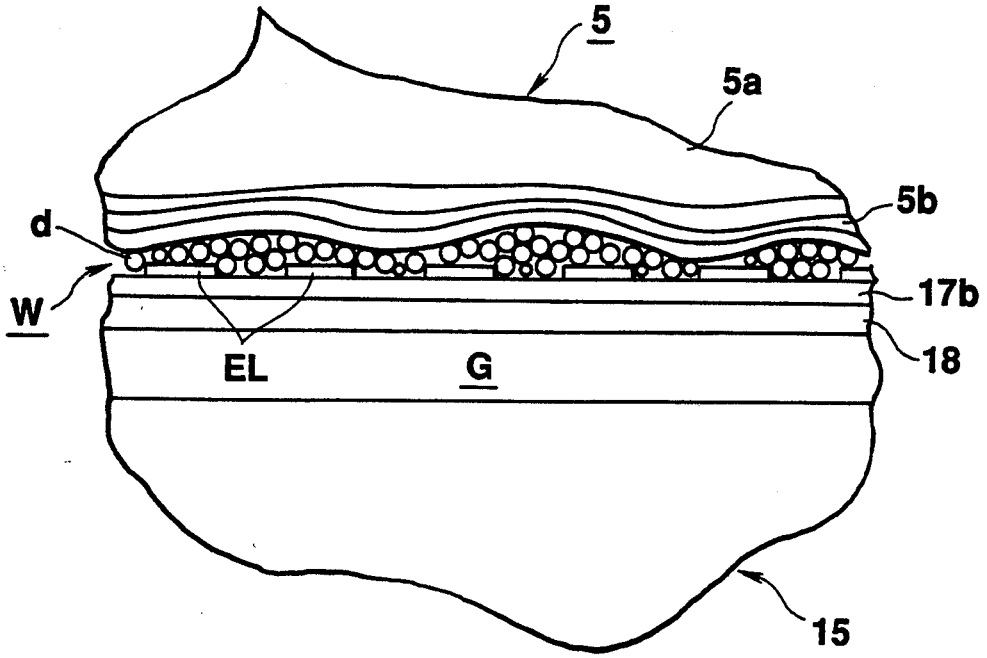
FIGS. 10A and 10B are views for explaining the operations of the recording units of the first and second embodiments, respectively, in different states.
Figure 10B:
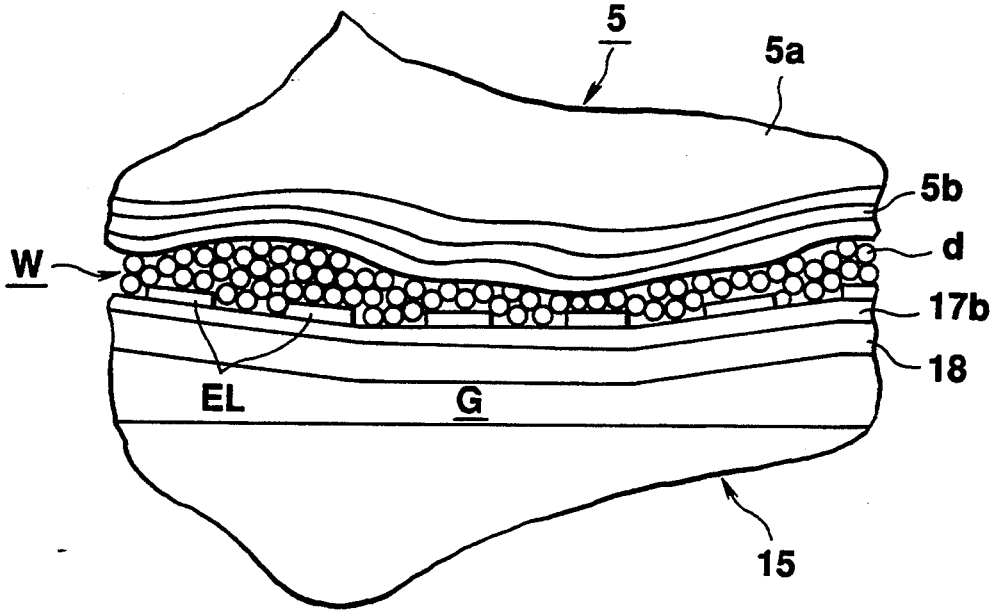

Before start of printing, the upper surfaces of the recording electrodes EL and the circumferential surface of the electrode cylinder 5 are in tight contact with each other, as shown in FIG. 9. In this state, as a magnet roll 16 is rotated, the magnetic toner d moves along the circumferential surface of the developing sleeve 15 in the direction of an arrow $\zeta$ toward the recording portion W, as shown in FIG. 4. In the recording portion W, as shown in FIG. 10A, a surface layer 5b of the electrode cylinder 5 made of the flexible elastic material sinks flexibly by an amount corresponding to the thickness of the magnetic toner d, and the conveyed magnetic toner d is clamped between the circumferential surface of the electrode cylinder 5 and the upper surfaces of the recording electrodes EL. In this case, the clamp force to the magnetic toner d is set at such a degree that the magnetic toner d which has been thickness-regulated by a doctor blade 12a (see FIG. 2) on the upstream side can move at an appropriate speed while it is further thickness-regulated by the clamp force. As a result, a uniform recording image having a sufficiently high image density can be stably obtained.

When a swing occurs in the rotation of the electrode cylinder 5, the circumferential surface of the electrode cylinder 5 is sometimes partly deflected close to the recording electrodes EL by about several to several tens μm. In this case, as shown in FIG. 10B, the recording electrodes EL opposing the deflected portion through the magnetic toner d flexibly sink toward the bottom portion of the step G in response to the swing of the circumferential surface of the electrode cylinder 5, thereby avoiding excessive clamp of the magnetic toner d. Since all the recording electrodes EL are supported by a single leaf spring member 18, the flexibilities of the recording electrodes EL do not depend on the thickness of the base film 17b but are uniform. Therefore, an appropriate gap necessary when clamping the magnetic toner d can always be maintained almost constantly between the electrode cylinder 5 and the recording electrodes EL throughout the entire width of the projecting size (see FIG. 6). As a result, the magnetic toner d may not be excessively compacted between the electrodes to decrease the electric resistance, and thus an excessive leakage current may not flow to heat the magnetic toner d and melt it.

Furthermore, even if the magnetic toner is compacted and melted, it may not fuse to attach to the recording electrodes EL. More specifically, when printing is completed and conveyance of the magnetic toner is stopped, if only the electrode cylinder 5 is rotated, the circumferential surface of the electrode cylinder 5 slidably contacts the upper surfaces of the recording electrodes EL to remove, by scraping, the fused magnetic toner attaching to the recording electrodes EL. Thus, the upper surfaces of the recording electrodes EL are always maintained to be free from any material attaching to them. Even if the electrode cylinder 5 is rotated while its circumferential surface slidably contacts the upper surfaces of the recording electrodes EL, the recording electrodes EL will not be worn as their surface layer is made of the flexible elastic material.

The third embodiment of the present invention will be described.

Figure 11:
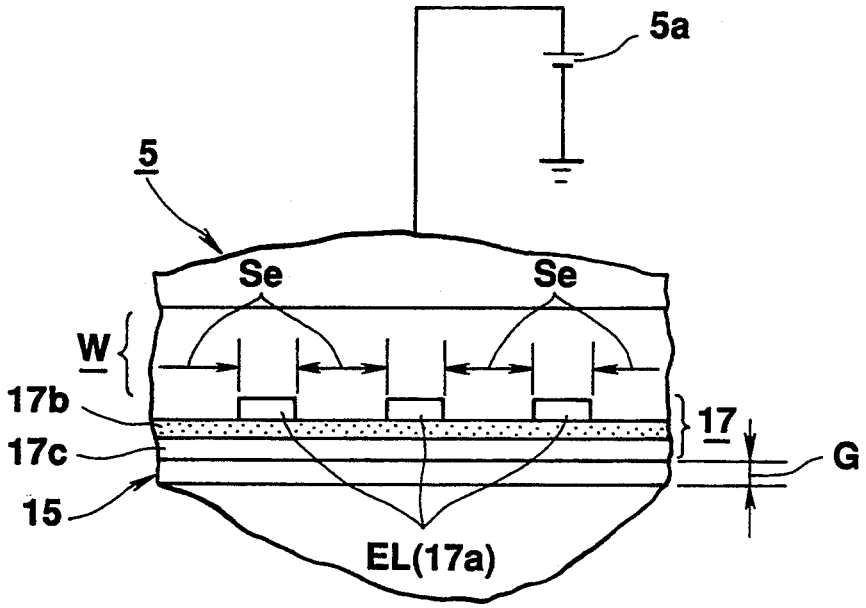
FIG. 11 is a schematic elevation of a recording unit of the third embodiment of the present invention seen from a downstream side.

In the third embodiment, as shown in the schematic elevation of FIG. 11 of a recording portion W seen from the downstream side, a multiple of recording electrodes EL are aligned on the circumferential surface of a developing sleeve 15 on the upstream side of a step G as described above at a predetermined pitch in the widthwise direction of the toner convey path (the axial direction of the developing sleeve 15). Basic film 17b, provided at the gap portions Se among the respective recording electrodes EL, is made of a material having substantially the same charge system characteristics, or electrification rank, as those of the material component of the developing agent employed. For example, when a two-component developing agent is used as the developing agent and its magnetic carrier is coated with a resin, as in this embodiment, the base film 17b may be made of the same material as that of the insulating resin component in the toner. In any case, note that the resin component material of the developing agent and the resin material to form the base film 17b are not necessarily the same but can be different as far as they have substantially the same charge system characteristics. In this manner, when the resin material having substantially the same charge system characteristics as those of the resin material component of the developing agent is selected as the material of the base film 17b, triboelectrification between the base film 17b and the developing agent can be reliably prevented. As a result, a recording electric field for forming a recording image can be correctly formed, and a high-quality recording image free from background smearing and having a sufficiently high image density can be stably formed. When a two-component developing agent is used, although the base film 17b causes friction not only with the carrier of the developing agent but also with its toner, the charge amount in this case is considerably small compared to that of triboelectrification caused with only the carrier and is thus negligible.

A modification of the third embodiment of the recording electrode portion will be described with reference to FIG. 12.

Figure 12:
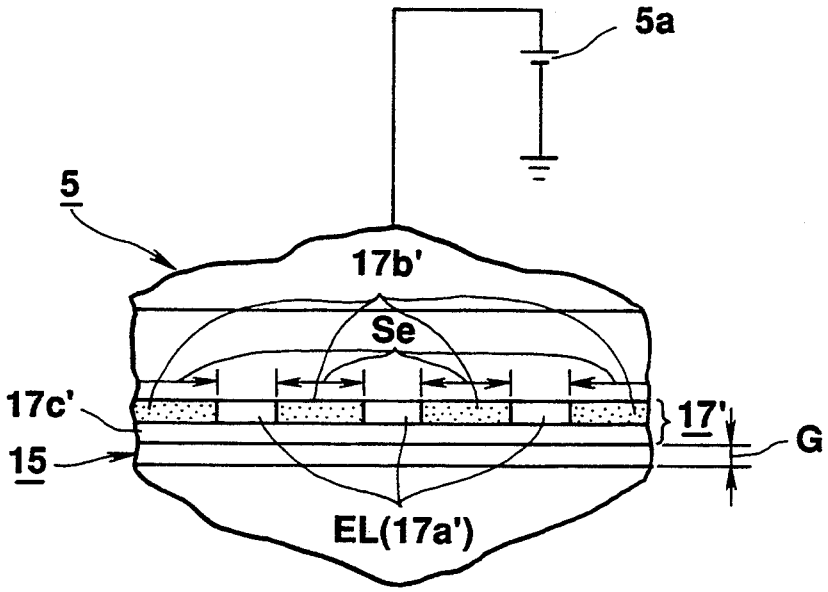
FIG. 12 is a schematic elevation of a modification of the third embodiment.

As shown in FIG. 12, in this modification, a multiple of recording electrodes EL (recording electrode wires 17a') are directly formed on a base film 17c', and the same material as that of the resin coated on the carrier is filled as gap portions Se among the recording electrodes EL to form electrode support layers 17b'. A recording electrode sheet 17' fabricated in this manner is applied on the circumferential surface of a developing sleeve 15 in the same manner as the embodiments described above. In this modification, triboelectrification between the electrode support layers 17b' which are formed by filling gap portions Se among the recording electrodes and the developing agent is prevented to obtain a desired effect.

The developing agent supplied to the recording portion W shown in FIG. 11 is conveyed as it causes friction with the surfaces of the recording electrodes EL and the surfaces of the gap portions Se. At this time, the gap portions Se can be easily charged by friction with the developing agent as they are usually made of, e.g., an insulating resin in order to maintain insulation among the electrodes EL. Particularly, when a developing agent whose carrier is coated with the resin is used in order to prolong the service life, as in this embodiment, the surfaces of the gap portions Se are triboelectrified more strongly to provide a potential of about several tens to several hundreds v depending on their material.

Figure 13A:
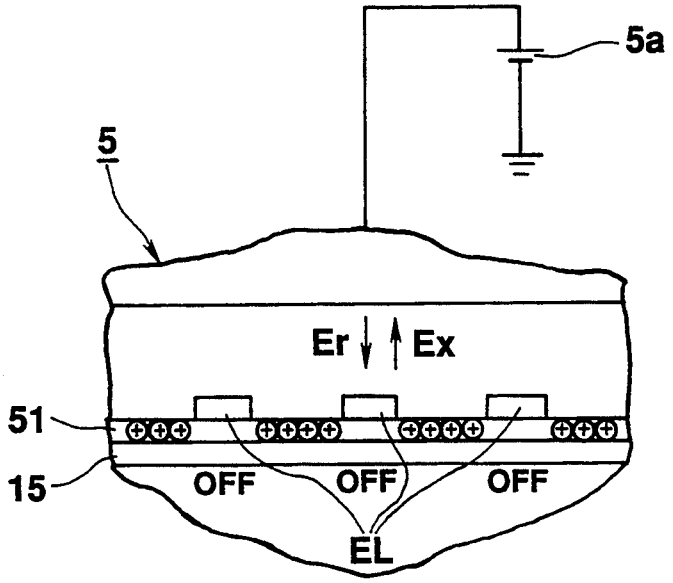
FIGS. 13A and 13B are schematic elevations of recording electrode portions, respectively, for explaining conventional problems.

FIG. 13A shows an arrangement in which a support sheet 51 for recording electrodes EL is made of a material that causes friction with the carrier of the developing agent to be positively charged. When a recording voltage to be applied to the respective recording electrodes EL is switched to the OFF voltage as the ground potential in order to form a non-image portion (background portion), a toner recovery electric field Er is formed between the recording electrodes EL and an electrode cylinder 5. At this time, if gap portions Se among the recording electrodes EL are positively triboelectrified to provide a potential higher than that of the electrode cylinder 5, a friction electric field Ex of the opposite direction to that of the toner recovery electric field Er is formed between the gap portions Se and the electrode cylinder 5. When the friction electric field Ex is increased to satisfy:

$$Ex-Er>0$$

the toner is transferred to the surface of the electrode cylinder 5 despite that the recording electrodes EL are at the OFF potential, thus causing background smearing. In order to prevent background smearing, a bias voltage of a bias power supply 5a may be adjusted to be equal to or higher than the potential of the gap portions Se. The potential of the gap portions Se largely depends on the environmental condition as it is caused by triboelectrification. Hence, in order to prevent background smearing by adjusting the bias voltage, the bias voltage must be changed in accordance with a change in environmental conditions, which is not practical.

Figure 13B:
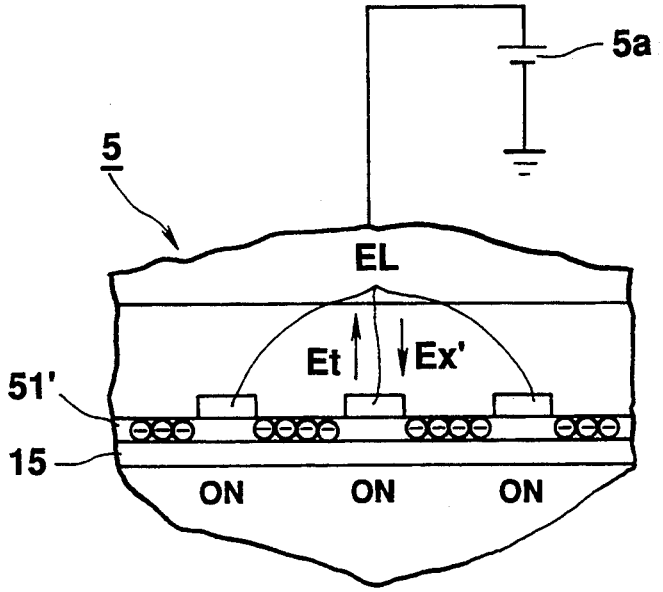

When a support sheet 51' is made of a material that is negatively charged by friction with the carrier, a friction electric field Ex' of a direction (the same direction as that of the toner recovery electric field) to attract the toner to recording electrodes EL is formed between gap portions Se among the recording electrodes EL and an electrode cylinder 5, as shown in FIG. 13B. Thus, no background smearing occurs when a non-image portion is to be formed, as described above. When an ON voltage is applied to the recording electrodes EL to form a toner transfer electric field Et between the recording electrodes EL and the electrode cylinder 5, as shown in FIG. 13B, thus forming black dots, the strength of the electric field for actually transferring the toner is:

$$Et-Ex'$$

and the image density is decreased. When the friction electric field Ex' is increased by a change in environmental conditions or the like, $$Et-Ex'<0$$

is satisfied, and the toner is no longer transferred to the circumferential surface of the electrode cylinder 5, and image formation is disabled. In this case, although a decrease in image density can be prevented by adjusting the bias voltage, it is not similarly practical because it depends on the environmental conditions.

In contrast to this, in the third embodiment, since an electrode support sheet 17b made of the same material as that of the resin coated on the carrier frictionally contacts the developing agent in the gap portions Se, as shown in FIG. 11, triboelectrification on the surfaces of the gap portions Se can be minimized. As a result, the friction electric field Ex or Ex' described above is not formed, background smearing, a decrease in image density, or the like caused by the friction electric field can be reliably prevented, thus enabling stable formation of a high-quality toner recording image.

Furthermore, referring to FIG. 2, a wall Swl of the wall Sw surrounding the central space S of the horizontal circulation path 13 described above which is close to the developing agent reservoir tank 12 extends on the downstream side of the toner convey direction $\zeta$ in the recording portion W, and the distal end of the wall Swl contacts the circumferential surface of the developing sleeve 15. Thus, a magnetic toner d', which has not been transferred in the recording portion W but remained on the circumferential surface of the developing sleeve 15 and conveyed along with rotation of a magnet roll 16, is scraped down onto the replenishment tank side path 13a of the horizontal circulation path 13, so that the magnetic toner d' will not enter the central space S or will not be directly returned to the upstream side along the circumferential surface of the developing sleeve 15 without passing through the horizontal circulation path 13. A special-purpose flat plate member for scraping the remaining magnetic toner d' attaching to the developing sleeve 15 may be provided independently of the wall surrounding the central space S. In this case, this scraping member may be supported in the vertical direction, its distal end may be abutted against the circumferential surface of the developing sleeve 15, and its other end may extend to reach the bottom portion of the central space S. If the scraping member is made of a magnetic material, the magnetic force of the magnet roll 16 can be blocked to obtain a smoother scraping/convey effect.

As described above, the recording electrode sheet 17 having a distal end projecting from the surface (not shown) of the step extends along about half the circumferential surface of the developing sleeve 15, extends horizontally, and then extends vertically downward to enter the central space S of the horizontal circulation path 13 described above. A plurality of drive circuit elements 19 for applying recording voltages to the respective recording electrodes EL in accordance with recording data are mounted on the vertical extending portion of the recording electrode sheet 17. The recording electrode wires 17*a* of the recording electrode sheet 17 described above are divided into groups each including N recording electrode wires 17*a* and connected to the drive circuit elements 19 in units of N, as shown in FIG. 5. When an end portion of the recording electrode sheet 17 where the drive circuit elements 19 are mounted, which is opposite to the other end projecting from the step G, is housed in the central space s, the drive circuit elements 19 can be protected from dust, e.g., the developing agent, and the developing/recording tank 12 can be made very compact.

A recording image forming operation of the electrostatic recording apparatus according to the present invention will be described.

Referring to FIG. 2, when the magnet roll 16 is rotated in the direction indicated by the arrow $\epsilon$, a rotating magnetic field for pivoting the particles of a magnetic toner d is formed on the circumferential surface of the developing sleeve 15, and the magnetic toner d is conveyed in the direction indicated by the arrow $\zeta$ opposite to the rotating direction of the magnet roll 16 while forming a magnetic brush. The distal ends of the magnetic brush made of the magnetic toner d under conveyance are regulated by the doctor blade 12*a* to a predetermined thickness, and thereafter the magnetic toner d reaches the recording portion W. At this time, the magnetic toner d is negatively magnetized by friction among the components of the magnetic toner d or between the magnetic toner d and the circumferential surface of the developing sleeve 15.

In the recording portion W, the electrode cylinder 5 is rotated while its circumferential surface contacts the multiple of recording electrodes EL aligned in the manner as shown in FIG. 9. When the magnetic toner is supplied among the recording electrodes EL, the magnetic toner d is clamped between the adjacent electrodes EL, so that its convey amount is regulated, and its thickness is decreased to be uniformed, as shown in FIG. 10A. When the recording portion W is in this state, the drive circuit elements 19 selectively apply recording voltages to the recording electrodes EL in accordance with the recording data, as described above. In this case, assume that 1-bit recording data is at, e.g., the "H" level. When a voltage of −200V is applied to a corresponding recording electrode EL, since a voltage of −50V is applied to a portion of the electrode cylinder 5 opposing this recording electrode EL by a bias power supply, a potential difference of 150V is formed to extend from the electrode cylinder 5 toward the recording electrode EL. Since the negatively charged magnetic toner d shifts to a higher-potential place, only the magnetic toner d on the recording electrode EL to which the voltage of −200V is applied is selectively transferred to the surface of the electrode cylinder 5 to form one black dot.

When the 1-bit recording data is at the "L" level, the corresponding recording electrode EL is at the ground potential. As a result, the potential difference of this recording electrode EL with respect to the electrode cylinder 5 is −50V, and the negatively charged magnetic toner d is kept held by this recording electrode EL and is not transferred.

As described above, the potentials of the respective recording electrodes EL are selectively controlled between −200V and the ground potential in accordance with input recording data, and a toner recording image corresponding to the recording data is formed on the surface of the electrode cylinder 5. In this case, since the magnetic toner d is very thin uniformly, as described above, a uniform recording image having a sufficiently high image density can be stably formed. Since all the recording electrodes EL are supported by the leaf spring member 18 to have uniform flexibilities and the surface layer 5*b* of the electrode cylinder 5 also is flexible, a gap appropriate for clamping the magnetic toner d between the recording electrodes EL and the electrode cylinder 5 is always correctly maintained. Hence, the magnetic toner d clamped between them may not be excessively compacted so as not to cause an excessive leakage current to flow through it, and thus the magnetic toner d may not be fused by overheat to attach to the recording electrodes EL. Even if the magnetic toner d should attach to the recording electrodes EL, the fused toner is scraped by the circumferential surface of the electrode cylinder 5 intermittently slidably contacting the recording electrodes EL, and is thus removed. As a result, the upper surfaces of the recording electrodes EL are always kept clean and free from a material attaching to them. Hence, a clear, high-resolution recording image faithful to the recording data can stably be formed.

Since the step G is formed in the recording portion W, as shown in FIG. 4, the magnetic toner d′ not used for image formation and remaining on the developing sleeve 15 moves away from the surface of the electrode cylinder 5 immediately after passing through the recording portion W. Accordingly, the toner recording image formed on the surface of the electrode cylinder 5 in the recording portion W will never be disturbed by mutual interference with the remaining magnetic toner d′.

Furthermore, since the recording electrodes EL are not coated with the insulating coating film 17*c* but are exposed, as shown in FIG. 5, unnecessary charges may not be accumulated on the recording electrodes EL. Accordingly, background smearing or a voltage leak phenomenon between adjacent recording electrodes EL that are caused by unnecessary charges are prevented, and a high-resolution, high-density, clear toner recording image can stably be formed.

Referring to FIG. 1, the toner recording image formed on the surface of the electrode cylinder 5 is conveyed to the image transfer unit T along with the counterclockwise rotation of the electrode cylinder 5 in the direction indicated by the arrow $\alpha$, and is transferred to a sheet which is fed by the pair of resist rollers 3 synchronously. To adjust the density of the toner recording image described above, the bias voltage of the bias power supply 5*c* may be changed. In this case, an appropriate adjustment range is about 0 to −50V. Closer the bias voltage to 0V, higher the image density.

Referring to FIG. 2, the magnetic toner d′, which is not transferred to the electrode cylinder 5 in the recording portion W but remains on the developing sleeve 15 shifts downstream along with rotation of the magnet roll 16, is scraped from the surface of the developing sleeve 15 by the scraping wall Swl to drop on the auger roll 14*a*, and is mixed, by agitation, with the magnetic toner d0 replenished through the replenishment port 11*b*.

As the auger roll 14*a* is rotated, the dropped and returned non-remaining magnetic toner d' and the replenishing magnetic toner d0 are circulated as they are mixed by agitation. Referring to FIG. 3, as the magnetic toner circulated in the direction indicated by the broken arrow δ is conveyed through the non-replenishing elongated path 13*b*, it is conveyed in the vertical direction again by the rotating magnetic field of the magnet roll 16 extending above the elongated path 13*b*.

As described above, the remaining magnetic toner d', which has not been transferred to the electrode cylinder 5 but conveyed downstream in the recording portion W, is scraped onto the horizontal circulation path 13, smoothly returned upstream while being agitated through the horizontal circulation path 13, and is used again for formation of a toner recording image. In this case, since the magnetic toner d which is not yet conveyed in the vertical direction is conveyed in the axial direction (the widthwise direction of the toner convey path: main scanning direction) of the developing sleeve 15 while being agitated, it is constantly uniformly supplied throughout the entire width of the circumferential surface of the developing sleeve 15. Accordingly, the magnetic toner d is constantly carried uniformly on the circumferential surface of the developing sleeve 15 throughout its entire width and conveyed to the recording portion W, so that a good recording image having a uniform image density can stably be obtained. When the magnetic toner d is circulated through the horizontal circulation path 13 while being agitated, the magnetic toner particles cause friction with each other to sufficiently triboelectrify the magnetic toner.

A comparative experiment was conducted in which image formation was actually performed by variously changing the material and structure of the surface layer 5*b* of the electrode cylinder 5, the base film 17*b* of the recording electrode sheet 17, and the leaf spring member 18, and the projection size Z, shown in FIGS. 4 and 6, within ranges satisfying the conditions of the surface hardness and volume electric resistivity of the electrode cylinder 5 and applying a load on the recording electrodes EL, described above. The result of the experiment will be described.

An electrostatic recording apparatus as shown in FIG. 1 was formed by following the conditions below. A surface layer 5*b* of an electrode cylinder 5 was formed of conductive urethane rubber having a surface hardness Hs of 90° and a volume electric resistivity of $1\times10^{11}$ [Ω·cm]. The thickness of a base film 17*b* was set to 50 μm, a leaf spring member 18 was formed of an SUS material having a thickness of 50 μm, and a projection size was set to 8.8 mm. This electrostatic recording apparatus which satisfied these conditions repeatedly performed recording image formation (printing) 10,000 times. Good image quality having no image defect, e.g., a white line, was stably obtained.

Subsequently, another electrostatic recording apparatus as shown in FIG. 1 was formed by following the conditions below. A surface layer 5*b* of an electrode cylinder 5 was formed of conductive silicone rubber having a surface hardness Hs of 30° and a volume electric resistivity of $1\times10^{7}$ [Ω·cm]. The thickness of a base film 17*b* was set to 25 μm, a leaf spring member 18 was formed of an SUS #304 material having a thickness of 50 μm, and a projection size was set to 8.8 mm. This electrostatic recording apparatus which satisfied these conditions repeatedly performed printing 10,000 times. Good image quality having no image defect, e.g., a white line, was stably obtained.

Furthermore, another electrostatic recording apparatus as shown in FIG. 1 was formed by following the conditions below. A surface layer of an electrode cylinder was made to have a two-layer structure in which a second surface layer was laid on a first surface layer. The first surface layer was formed of acrylic urethane rubber having a volume electric resistivity of $1\times10^{11}$ to $1\times10^{12}$ [Ω·cm], and the second surface layer was formed of nitrile rubber (NBR) having a volume electric resistivity of $1\times10^{6}$ [Ω·cm], thereby forming the electrode cylinder having the total volume electric resistivity of $1\times10^{6}$ [Ω·cm] in the entire surface layer and a surface hardness Hs of 60°. The thickness of a base film was set to 25 μm, a leaf spring member was formed of an SUS #304 material having a thickness of 50 μm, and a projection size was set to 8.8 mm. This electrostatic recording apparatus which satisfied these conditions repeatedly performed printing 10,000 times. Good image quality having no image defect, e.g., a white line, was stably obtained.

Another electrostatic recording apparatus as shown in FIG. 1 was formed by following conditions below. A surface layer 5*b* of an electrode cylinder 5 was formed of conductive silicone rubber having a surface hardness Hs of 90° and a volume electric resistivity of $1\times10^{11}$ [Ω·cm]. The thickness of a base film 17*b* was set to 50 μm, a leaf spring member 18 was formed of an SUS #304 material having a thickness of 100 μm, and a projection size was set to 5 mm. This electrostatic recording apparatus which satisfied these conditions repeatedly performed printing 10,000 times. Remarkable carrier tailing was observed in an obtained image.

Another electrostatic recording apparatus as shown in FIG. 1 was formed by following conditions below. A surface layer 5*b* of an electrode cylinder 5 was formed of conductive silicone rubber having a surface hardness Hs of 90° and a volume electric resistivity of $1\times10^{11}$ [Ω·cm]. The thickness of a base film 17*b* was set to 50 μm, a leaf spring member 18 was formed of an SUS #304 material having a thickness of 10 μm, and a projection size was set to 10 mm. This electrostatic recording apparatus which satisfied these conditions repeatedly performed printing 10,000 times. Remarkable background smearing was observed in an obtained image.

It is to be understood that the present invention is not limited to the specific embodiments described above, and various changes and modifications may be made within the spirit and scope of the invention.

For example, in the first and second embodiments, the elastic support member for the recording electrodes is not limited to a spring leaf member, and a variety of elastic materials can be used for this as far as they have an elastic coefficient E satisfying:

$$1\times10^{3}\leqq E\leqq3\times10^{9}[N/m^{2}]$$

When an opposite electrode is formed of an ordinary rigid member and recording electrodes and the opposite electrode are set to oppose each other at a small gap without bringing them into tight contact, the present invention can similarly be adopted. Furthermore, a variety of leaf spring members, e.g., a phosphor bronze plate, may be used as the leaf spring member in place of one made of the SUS material. In addition, in the second and third embodiments, as the toner, one that can be negatively (−) charged is used. However, a toner that can be positively (+) charged can also be used. In this case, the bias voltage to be applied to the recording electrodes and the opposite electrode may be set to have a positive (+) polarity.

As has been described above in detail, in the first and second embodiments of the present invention, a step is formed in the surface of a developing agent carrier member serving as a developing agent convey path, and a plurality of recording electrodes aligned in the widthwise direction of the developing agent convey path and supported by a leaf spring member are set to project from an upper surface of the step downstream in the developing agent convey path. Hence, a gap where the recording electrodes and the opposite electrode clamp the developing agent can always be maintained at an appropriate width. As a result, a high-density, high-quality recording image free from background smearing can stably be formed over a long period of time. Also, the developing agent can be conveyed as it is always clamped between the recording electrodes and the opposite electrode at an appropriate pressure. Wear among the recording electrodes can be prevented. Also, an inconvenience in which an excessive leakage current flows through an excessively compacted developing agent to melt it, thus causing the molten developing agent to attach to the recording electrodes, can be reliably prevented. If the opposite electrode is formed of an elastic material and brought into tight contact with the recording electrodes, the surfaces of the opposite electrode and the recording electrodes are always cleaned by friction to keep them free from soil.

In the second embodiment, recording electrodes are aligned on the flat surface of a support member, and the resultant structure is fixed to a flat portion of a developing agent carrier member. Hence, the recording electrodes can be precisely, easily formed and be reliably placed on the developing agent carrier member.

In the third embodiment, gap portions among recording electrodes aligned on a developing agent convey path are formed of a resin material having substantially the same charge system characteristics as those of the resin material of the developing agent. Hence, charging of the gap portions among the recording electrodes caused by friction with the developing agent can be reliably prevented. As a result, a high-quality recording image having a sufficiently high image density and free from background smearing can stably be formed over a long period of time.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An electrostatic recording apparatus comprising:

a developing agent carrier member having a surface and provided to extend along a predetermined path;

developing agent convey means for conveying a developing agent along said surface of said developing agent carrier member, said developing agent carrier member having a step in a developing agent convey direction of said surface thereof;

a plurality of recording electrodes aligned on an upper surface of said step of said developing agent carrier member and spaced apart from each other with gaps therebetween in a direction perpendicular to the developing agent convey direction, and projecting uniformly from said step;

an opposite electrode disposed to oppose said plurality of recording electrodes;

a leaf spring member for supporting at least portions of said plurality of recording electrodes projecting from said step, said leaf spring member being capable of swinging said projecting recording electrodes in directions to approach to and to separate from said opposite electrode;

voltage applying means for applying recording voltages to said plurality of recording electrodes in accordance with recording data to selectively transfer said developing agent conveyed along said surface of said developing agent carrier member to said opposite electrode; and at least a surface portion of said opposite electrode opposing said plurality of recording electrodes being constituted by an elastic member, and said opposite electrode and said plurality of recording electrodes are disposed to be in such contact with each other that at least either of said plurality of recording electrodes and said opposite electrode is deformed.

2. An electrostatic recording apparatus comprising:

a developing agent carrier member having a surface and provided to extend along a predetermined path;

developing agent convey means for conveying a developing agent along said surface of said developing agent carrier member;

a plurality of recording electrodes aligned on said surface of said developing agent carrier member and spaced apart from each other with predetermined gaps therebetween;

said developing agent carrier member being substantially parallel with a developing agent convey direction and having a flat portion formed throughout an entire surface of said developing agent carrier member in a main scanning direction, and said plurality of recording electrodes being stacked with an elastic support member for supporting said plurality of recording electrodes on said flat portion so as to uniformly project from said flat portion;

opposite electrode disposed to oppose said plurality of recording electrodes;

voltage applying means for applying recording voltages to said plurality of recording electrodes in accordance with recording data to selectively transfer said developing agent conveyed along said surface of said developing agent carrier member to said opposite electrode; and at least a surface portion of said opposite electrode opposing said plurality of recording electrodes being constituted by an elastic member, and said opposite electrode and said plurality of recording electrodes are disposed to be in such contact with each other that at least either of said plurality of recording electrodes and said opposite electrode is deformed.

3. An apparatus according to claim 2, wherein said elastic support member has an elastic coefficient E satisfying:

$$1\times10^3 \leqq E \leqq 3\times10^9 [N/m^2]$$

4. An electrostatic recording apparatus comprising:

a developing agent carrier member having a surface and provided to extend along a predetermined path;

developing agent convey means for conveying a developing agent along said surface of said developing agent carrier member;

a plurality of recording electrodes aligned on said surface of said developing agent carrier member and spaced apart from each other with predetermined gaps therebetween in a direction perpendicular to a developing agent convey direction;

another member provided at locations of the predetermined gaps where said developing agent is conveyed and having an electrification rank, said electrification rank of said another member being substantially the same as that of an electrification rank of said developing agent;

an opposite electrode disposed to oppose said plurality of recording electrodes; and voltage applying means for applying recording voltages to said plurality of recording electrodes in accordance with recording data to selectively transfer said developing agent conveyed along said surface of said developing agent carrier member to said opposite electrode.

5. An apparatus according to claim 4, wherein said recording electrodes are placed on said another member.

6. An apparatus according to claim 4, wherein surfaces of said recording electrodes and surfaces of said another member at said predetermined gaps form a flat surface.

7. An apparatus according to claim 4, wherein said developing agent is a two-component developing agent consisting of a toner and resin-coated carrier, and a resin coated on said resin-coated carrier and said another member have substantially the same electrification rank.

* * * * *